US011225837B2

(12) United States Patent
Han et al.

(10) Patent No.: US 11,225,837 B2
(45) Date of Patent: Jan. 18, 2022

(54) DUAL-SPEED DUAL—CORE ENHANCED DRILLING EQUIPMENT

(71) Applicants: CNPC CHUANQING DRILLING ENGINEERING COMPANY LIMITED, Chengdu (CN); CCDC PETROLEUM DRILLING & PRODUCTION TECHNOLOGY CO LTD, Guang Han (CN)

(72) Inventors: Liexiang Han, Guang Han (CN); Zuo Chen, Chengdu (CN); Bin Liu, Guang Han (CN); Xiaofeng Yang, Chengdu (CN); Sheng Yu, Guang Han (CN); Jianlin Yao, Guang Han (CN); Gang Zhou, Guang Han (CN); Ming Feng, Guang Han (CN); Shiming Dong, Guang Han (CN); Kunpeng Yao, Guang Han (CN); Weicheng Li, Guang Han (CN); Lei Li, Guang Han (CN); Xiaoping Fu, Guang Han (CN); Zhijun Lyu, Guang Han (CN); Wencai Chen, Guang Han (CN); Yong Li, Guang Han (CN)

(73) Assignees: CNPC CHUANQING DRILLING ENGINEERING COMPANY LIMITED, Chengdu (CN); CCDC PETROLEUM DRILLING & PRODUCTION TECHNOLOGY CO LTD, Guang Han (CN)

( * ) Notice: Subject to any disclaimer, the term of this patent is extended or adjusted under 35 U.S.C. 154(b) by 0 days.

(21) Appl. No.: 17/132,397

(22) Filed: Dec. 23, 2020

(65) Prior Publication Data

US 2021/0198950 A1 Jul. 1, 2021

(30) Foreign Application Priority Data

Dec. 31, 2019 (CN) ..... 201911403401.0
Dec. 31, 2019 (CN) ..... 201911409751.8

(51) Int. Cl.
*E21B 10/26* (2006.01)
*E21B 4/02* (2006.01)
*E21B 21/10* (2006.01)

(52) U.S. Cl.
CPC ..... *E21B 10/26* (2013.01); *E21B 4/02* (2013.01); *E21B 21/10* (2013.01)

(58) Field of Classification Search
CPC . E21B 10/26; E21B 4/02; E21B 21/10; E21B 17/00
See application file for complete search history.

(56) References Cited

U.S. PATENT DOCUMENTS 7,562,725 B1 * 7/2009 Broussard ..... E21B 7/28 175/107
2003/0141111 A1 * 7/2003 Pia ..... E21B 7/208 175/57

(Continued)

*Primary Examiner* — Caroline N Butcher
(74) *Attorney, Agent, or Firm* — WPAT, PC

(57) ABSTRACT

A dual-speed and dual-core enhanced drilling equipment which has an outer cylinder, a downhole power device, a large cutting head and a small cutting head. Specifically, the large cutting head has a first centerline, a through hole arranged along the first centerline and a first diameter. The outer cylinder, which is sleeved outside the downhole power device, is connected to the upper drill string with the large cutting head to enable rotation among the large cutting head, downhole power device and upper drill string. The downhole power device has a power generation section capable of generating power, and a rotation output section which connects to, and provides independent power for the small cutting head, so that the small cutting head revolves around (Continued)

the first centerline under the driving of the upper drill string while rotating under the driving of the downhole power device.

20 Claims, 8 Drawing Sheets

(56) References Cited

U.S. PATENT DOCUMENTS

| | | | | |
|---|---|---|---|---|
| 2006/0237234 | A1* | 10/2006 | Dennis | E21B 4/16 175/95 |
| 2012/0273275 | A1* | 11/2012 | Broussard, Jr. | E21B 7/002 175/57 |
| 2014/0041942 | A1* | 2/2014 | Able | E21B 21/12 175/57 |
| 2018/0238114 | A1* | 8/2018 | Huber | B21C 37/207 |

* cited by examiner

DUAL-SPEED DUAL—CORE ENHANCED DRILLING EQUIPMENT

CROSS-REFERENCE TO RELATED APPLICATION

The present application claims priorities from China Patent Applications No. 201911403401.0 and 201911409751.8, filed on Dec. 31, 2019 and Dec. 31, 2019 respectively, in the State Intellectual Property Office of P. R. China, the disclosures of which are incorporated herein in its entirety by reference.

TECHNICAL FIELD

One or more embodiments described herein relate to the field of oil and gas drilling speed increasing, and particularly relates to a dual-speed dual-core enhanced drilling equipment capable of further increasing the drilling speed.

BACKGROUND

In the oil and gas well drilling engineering, how to increase the drilling speed is an important subject of research. Although the drilling speed is improved to certain extent by optimizing the design of the drill bit structure, for example, developing new drill bit tooth materials, higher performance teeth, etc., the problem that the linear speed of the central point of the drill bit is zero and the smaller linear speed near the central point affects the drilling speed during drilling is still not solved.

Moreover, the inventors have found that this effect is particularly pronounced in PDC bits which are currently in large use. It is also not difficult to find from the bit which is pulled out of service that this problem is one of the key problems affecting the speed increase of the well.

SUMMARY

An exemplary embodiment aims to address at least one of the above-mentioned deficiencies of the prior art. For example, one of the objectives of the exemplary embodiment is to solve the technical problem of zero linear velocity of the center point of the drill bit during drilling.

In order to achieve the above object, one aspect of exemplary embodiment provides a dual-speed dual-core enhanced drilling equipment which comprises an outer cylinder, a downhole power device, a large cutting head and a small cutting head, wherein the large cutting head having a first centerline, a through hole disposed along the first centerline, and a first diameter, the small cutting head having a second centerline and a second diameter, the second diameter being smaller than the first diameter, the second centerline being parallel to but not coincident with the first centerline; the outer cylinder is sleeved outside the downhole power device and forms an annular space, a left end of the outer cylinder is directly connected with an upper drill string, and a right end of the outer cylinder is directly connected with the large cutting head, so that the large cutting head can drill under the driving of the upper drill string, and the downhole power device can rotate under the driving of the upper drill string; the downhole power device comprises a power generation section and a rotation output section, wherein the power generation section can generate power and rotate the rotation output section, and the rotation output section passes through the through hole of the large cutting head and is connected with the small cutting head and can drive the small cutting head to rotate.

In one exemplary embodiment, a distance between the first centerline and the second centerline may be 1/50~1/10 of the first diameter.

In an exemplary embodiment, a ratio of an angular velocity of the small cutting head to an angular velocity of the large cutting head may be 4 to 7:1.

In an exemplary embodiment, the outer cylinder may further comprise a quincunx-like cavity fixedly disposed in the right end thereof, the quincunx-like cavity is capable of righting the power generation section or the rotation output section, or a portion of the small cutting head coupled to the rotation output section.

In an exemplary embodiment, the outer cylinder may further comprise a diversion member disposed in the left end thereof and located between the upper drill string and the power generation section, the diversion member has a plurality of diversion holes being capable of communicating drilling fluid in the upper drill string with the annular space and forming a first fluid stream and a central hole being capable of communicating drilling fluid of the upper drill string with the power generation section and forming a second fluid stream, and the first fluid stream being capable of lubricating a large cutting head, the second fluid stream being capable of powering the power generation section.

Another exemplary embodiment also aims to provide a drilling speed-up equipment which can effectively solve the problem that the linear velocity of the central point of the drill bit is zero during drilling, has good stability and service life, and realizes power driving by using the shunted drilling fluid.

To achieve this object, another aspect of the exemplary embodiment provides a dual-speed dual-core enhanced drilling equipment which comprises a flow dividing device, an outer cylinder, an downhole power device, a righting device, a large cutting head and a small cutting head, wherein the large cutting head having a first centerline, a through hole disposed along the first centerline, and a first diameter, the small cutting head having a second centerline and a second diameter, the second diameter being smaller than the first diameter, the second centerline being parallel to but not coincident with the first centerline; the outer cylinder is sleeved outside the downhole power device to form an annular space, a left end of the outer cylinder is connected with an upper drill string through the flow dividing device, and a right end of the outer cylinder is connected with the large cutting head through the righting device, so that the large cutting head can drill under the driving of the upper drill string, and the downhole power device rotates under the driving of the upper drill string; the downhole power device is provided with a power generation section and a rotation output section, wherein the power generation section can generate power and rotate the rotation output section, and the rotation output section passes through the through hole of the large cutting head and is connected with the small cutting head and can drive the small cutting head to rotate; the righting device is configured to right the power generation section, the rotation output section, or the small cutting head; the flow dividing device is configured to separate drilling fluid in the upper drill string into a first fluid stream that enters the annular space and lubricates the large cutting head and a second fluid stream that enters the power generation section of the downhole power device.

In an exemplary embodiment, the distance between the first centerline and the second centerline may be 1/50-1/10 of the first diameter.

In an exemplary embodiment, the ratio of the angular velocity of the small cutting head to the angular velocity of the large cutting head may be 4 to 7:1.

In an exemplary embodiment, the cutting head may have a jet channel with a gradually decreasing radial cross-sectional area, one end of the jet channel receiving the second fluid stream flowing through the power generation section and emitting from the other end of the jet channel.

In an exemplary embodiment, the righting device may have a quincunx-like cavity capable of righting the power generation section or the rotation output section, or of righting a portion of the small cutting head coupled to the rotation output section.

In an exemplary embodiment, the flow dividing device may have a diversion member which has a central hole and a plurality of diversion holes, the plurality of diversion holes are configured to communicate drilling fluid in the upper drill string with the annular space and form the first fluid stream, and the central hole is configured to communicate drilling fluid in the upper drill string with the power generation section and form the second fluid stream.

Another aspect of the exemplary embodiment provides a manufacturing method of the dual-speed dual-core enhanced drilling equipment which comprises the following steps: forming the flow dividing device, the outer cylinder, the downhole power device, the righting device, the large cutting head and the small cutting head; the flow dividing device, the outer cylinder, the underground power device, the righting device, the large cutting head and the small cutting head are assembled to form the dual-speed dual-core enhanced drilling equipment.

Another aspect of the exemplary embodiment provides a dual-speed dual-core enhanced drilling equipment which comprises a flow dividing device, an outer cylinder, a downhole power device, a righting device, a large cutting head and a small cutting head, wherein the large cutting head has a first centerline, a receiving-coupling portion and a hollow cutting portion having a first diameter, the receiving-coupling portion and the hollow cutting portion fixedly coupled to each other along the first centerline, the small cutting head has a second centerline and a second diameter, the receiving-coupling portion has a coupling member and an inner volume cavity disposed along the first centerline, the inner volume cavity being capable of receiving the small cutting head, the second centerline being parallel to but not coincident with the first centerline, the second diameter being smaller than the first diameter; the outer cylinder is sleeved outside the downhole power device to form an annular space, a left end of the outer cylinder is connected with an upper drill string through the flow dividing device, and a right end of the outer cylinder is connected with the coupling member of the receiving-coupling portion of the large cutting head through the righting device, so that the large cutting head can drill under the driving of the upper drill string, and meanwhile, the downhole power device rotates under the driving of the upper drill string; the downhole power device is provided with a power generation section and a rotation output section, wherein the power generation section can generate power and rotate the rotation output section, and a right end of the rotation output section enters the inner volume cavity of the receiving-coupling portion of the large cutting head to be connected with the small cutting head and can drive the small cutting head to rotate; the righting device is configured to right the power generation section, the rotation output section, or the small cutting head; and the flow dividing device is configured to separate drilling fluid in the upper drill string into a first fluid stream that enters the annular space and lubricates the large cutting head and a second fluid stream that enters the power generation section of the downhole power device.

Compared with the prior art, the beneficial effects of the exemplary embodiment comprise at least one of the following:

1. the linear speed of the central point of the large drill bit can be prevented from being zero during drilling, and the drilling speed can be improved;
2. the stability and the service life are good;
3. the small cutting head can be driven to rotate by the shunted drilling fluid;
4. the large cutting head and the small cutting head are arranged in a non-centrosymmetric manner, so that the small cutting head not only can rotate at a high speed under the driving of a downhole power device, but also can simultaneously revolve around the central axis of the large cutting head; therefore, the problems that the theoretical cutting speed of the central point of the drill bit is zero and the linear speed near the central point is low are solved, and the drilling speed is favorably improved.

Figure 1:
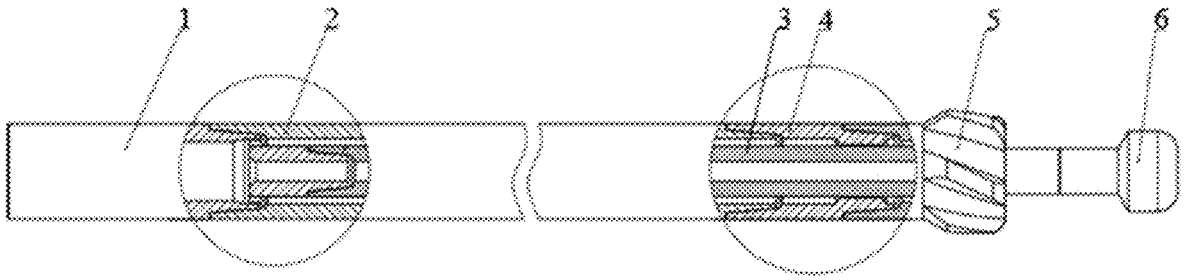
FIG. 1 illustrates a schematic diagram of the dual-speed dual-core enhanced drilling equipments according to one exemplary embodiment.

The reference numerals are explained below:

In FIG. 1 to 9, 1—flow dividing device, 2—outer cylinder, 3—downhole power device, 4—righting device, 5—large cutting head, 6—small cutting head, 1*a*—diversion hole, 1*b*—central hole, 4*a*—inner boss, 4*b*—concave surface, 1'—outer cylinder, 2'—downhole power device, 3'—large cutting head and 4'—small cutting head; and In FIG. 10 to 13, 11—flow dividing device, 12—outer cylinder, 13—downhole power device, 14—righting device, 15—large cutting head, 16—small cutting head, 15*a*—external cutting surface, 15*b*—internal cutting surface, 15*c*—runner groove.

DETAILED DESCRIPTION

Hereinafter, a dual-speed, dual-core enhanced drilling equipments of the exemplary embodiment will be described in detail with reference to exemplary embodiments and drawings. It should be noted that terms of "first", "second", "third", "fourth", "fifth", etc. are merely for convenience of description and for convenience of distinction, and are not to be construed as indicating or implying relative importance. Also terms of "left," "right," "inner," and "outer" are merely for convenience of description and relative orientation or positional relationship, and do not indicate or imply that the referenced components must have that particular orientation or position.

In general, to solve the problem of zero linear velocity at the center point of the drill bit, the inventors propose a dual-speed dual-core enhanced drilling equipment. The dual-speed dual-core enhanced drilling equipment is configured to include a large cutting head (also called a large drill bit) with a first centerline, a through hole arranged along the first centerline and a first diameter, and a small cutting head (also referred to as a small drill bit) having a second centerline and a second diameter, and ensure that the second diameter is smaller than the first diameter, and the second centerline being parallel to but not coincident with the first centerline, thereby realizing "dual-core". At the same time, the large cutting head receives a first power for rotary drilling through the upper drill string and is provided with lubrication by drilling fluid from the upper drill string; the small cutting head obtains a second power for rotary drilling through the downhole power device, which is equivalent to the small cutting head rotating around the second centerline, and the upper drill string can also drive the downhole power device to further drive the small cutting head to rotate, which is equivalent to the small cutting head revolving around the first centerline, thereby realizing "dual-speed".

FIG. 1 illustrates a schematic diagram of the dual-speed dual-core enhanced drilling equipments according to one exemplary embodiment.

As shown in FIG. 1, in a first exemplary embodiment, a dual-speed dual-core enhanced drilling equipments comprises a flow dividing device 1, an outer cylinder 2, a downhole power device 3, a righting device 4, a large cutting head 5 and a small cutting head 6.

The large cutting head 1 has a first centerline (i.e. parallel to the left-right direction in FIG. 1), a through hole arranged along said first centerline, and a first diameter. The cutting head 6 has a second centerline and a second diameter. And, the second diameter is smaller than the first diameter, and the second centerline is parallel to but not coincident with the first centerline. That is, both the first centerline and the second centerline are parallel to the left-right direction in FIG. 1, but a predetermined distance exists therebetween. For example, the distance between the first centerline and the second centerline may be 1/50-1/10 of the first diameter. As another example, the distance between the first centerline and the second centerline may be 1/20 for the first diameter.

The outer cylinder 2 is sleeved outside the downhole power device 3, and an annular space is formed between the outer cylinder and the downhole power device. And the left end of the outer cylinder 2 is connected with an upper drill string (not shown in FIG. 1) through the flow dividing device 1, and the right end of the outer cylinder 2 is connected with the large cutting head 5 through the righting device 4, so that the large cutting head 5 can drill under the driving of the upper drill string, and the downhole power device 3 rotates under the driving of the upper drill string. That is, the flow dividing device 1, the outer cylinder 2, the righting device 4 and the large cutting head 5 are fixed integrally with the upper drill string and are rotatable together.

The downhole power device 3 may have a power generation section and a rotation output section. Wherein the power generation section (e.g., the left section of the downhole power device 3 in FIG. 1) is capable of generating power and rotating the rotation output section. Further, the downhole power device can also form an annular space with the outer cylinder, and a power generation section of the downhole power device is fixedly connected with one or more of the upper drill string, the flow dividing device, the outer cylinder, the righting device and the large cutting head, so that the downhole power device can be driven by the upper drill string to rotate. The rotation output section (e.g., the right portion of the downhole power device 3 in FIG. 1) is coupled to the small cutting head through the through hole of the large cutting head and can drive the small cutting head to rotate. That is, the downhole power device can generate power through the power generation section and drive the small cutting head to rotate around the second centerline through the rotation output section; simultaneously, due to the drive of the upper drill string, the downhole power device and the small cutting head can also revolve around the first centerline. Thus, the angular velocity of the small cutting head will be greater than the angular velocity of the large cutting head. For example, the ratio of the angular velocity of the small cutting head to the angular velocity of the large cutting head may be 2 to 9:1. For another example, the ratio of the angular velocity of the small cutting head to the angular velocity of the large cutting head may be 4 to 7:1.

As shown in FIG. 1, the righting device is configured to centralize the power generation section of the downhole power device, thereby centralizing the small cutting head. That is, the righting device is capable of centralizing the deflection caused by the rotation of the cutting head. However, the exemplary embodiment is not limited thereto. For example, the righting device may also be arranged to centralize the rotation output section of the downhole power device; or directly centralize the cutting head, e.g., centralize the portion of the cutting head coupled to the rotation output section. For example, the righting device may have a quincunx-like cavity that can more stably right the power generation section or the rotation output section, or can more stably right the portion of the small cutting head coupled with the rotation output section.

The flow dividing device is configured to separate the drilling fluid in the upper drill string into a first fluid stream and a second fluid stream. The first fluid stream enters an annular space between the outer cylinder and the downhole power device and is able to flow to the large cutting head to lubricate the large cutting head. The second fluid stream enters a power generation section of the downhole power device and serves as a power source for the power generation section. That is, the power generation section can convert the power of the second fluid stream into the rotational motion of the rotation output section. For example, the flow dividing device can have a diversion member that can have a central hole and a plurality of diversion holes disposed thereon. Wherein the plurality of diversion holes are capable of communicating drilling fluid in an upper drill string with the annular space and forming the first fluid stream; the central hole is configured to communicate drilling fluid of an upper drill string with the power generation section and form the second fluid stream.

In addition, the small cutting head may also have a jet channel with a gradually decreasing radial cross-sectional area. One end of the jet channel receives the second fluid stream passing through the power generation section and is jetted out from the other end of the jet channel to be jetted toward an object to be drilled (e.g., a surface to be drilled).

Figure 2:
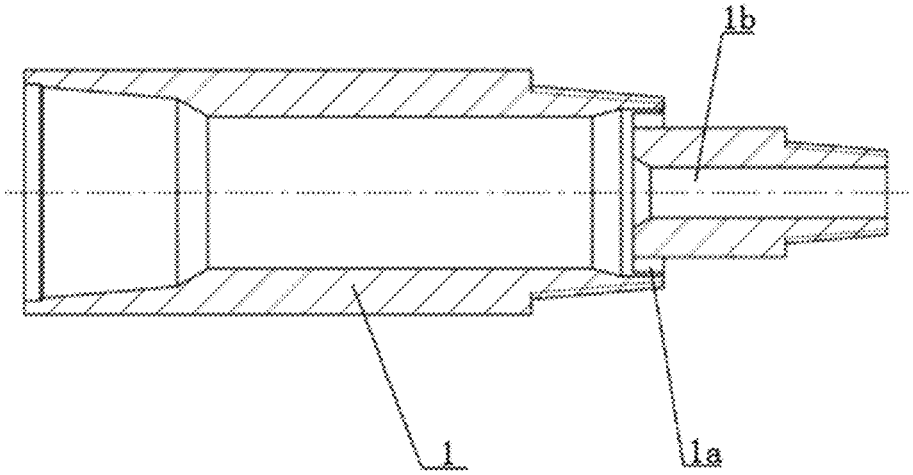
FIG. 2 illustrates a schematic structural view of a flow dividing device in the dual-speed dual-core enhanced drilling equipments according to the exemplary embodiment.
Figure 3:
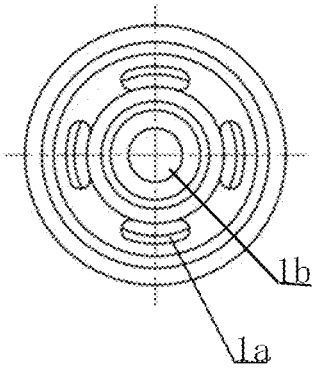
FIG. 3 illustrates a right side view of FIG. 2.
Figure 4:
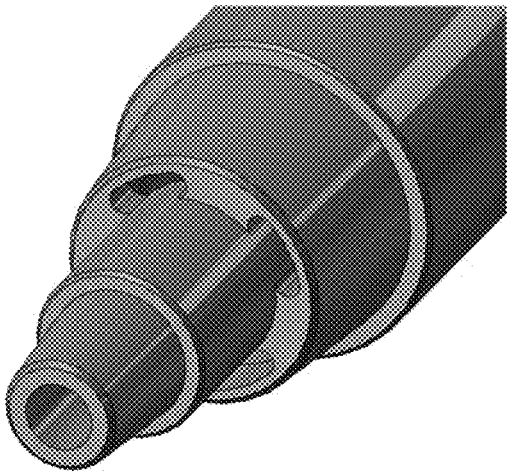
FIG. 4 illustrates a pictorial representation of FIG. 2.

FIG. 1 illustrates a schematic structural view of an exemplary embodiment of a dual-speed, dual-core enhanced drilling equipments according to an exemplary embodiment. FIG. 2 illustrates a schematic diagram of a flow dividing device in an exemplary embodiment of a dual-speed dual-core enhanced drilling equipments according to the exemplary embodiment. FIG. 3 shows a right side view of FIG. 2. And FIG. 4 shows a pictorial representation of FIG. 2.

In a second exemplary embodiment, as shown in FIG. 1, a dual-speed dual-core enhanced drilling equipments comprises a flow dividing device 1, an outer cylinder 2, a downhole power device 3, a righting device 4, a large cutting head 5 and a small cutting head 6.

In the exemplary embodiment, the left end of the outer cylinder 2 is connected with the upper drill string through the flow dividing device 1, and the right end of the outer cylinder 2 is connected with the large cutting head 5 through the righting device 4, so that the rotation torque of the upper drill string is transmitted to the large cutting head 5, and the large cutting head 5 can drill rotationally under the driving of the upper drill string. The outer cylinder 2 is indirectly connected with the upper drill string, and the outer cylinder 2 is indirectly connected with the large cutting head 5. For example, the left end of the outer cylinder 2 is connected with the right end of the flow dividing device 1 through threads, and the left end of the flow dividing device 1 is connected with the upper drill string through threads, so that the outer cylinder 2 is connected with the upper drill string, and the outer cylinder 2 can be driven by the upper drill string to rotate; the right end of the outer cylinder 2 is in threaded connection with the left end of the righting device 4, and the right end of the righting device 4 is in threaded connection with the left end of the large cutting head 5, so that the righting device 4 and the large cutting head 5 can rotate together with the outer cylinder 2. However, the exemplary embodiment is not limited thereto, and the upper drill string and the flow dividing device, the flow dividing device and the outer cylinder, the outer cylinder and the righting device, and the righting device and the large cutting head may be connected by other means (for example, snap-fitting), as long as the connection of the upper drill string, the flow dividing device, the outer cylinder, the righting device and the large cutting head and the transmission of the torque of the upper drill string can be realized.

In the present exemplary embodiment, the downhole power device 3 is disposed inside the outer cylinder 2, and the downhole power device 3 and the outer cylinder 2 are in a fixed state therebetween. The downhole power device 3 can rotate together with the outer cylinder 2 under the driving of an upper drill string, and an annular space through which drilling fluid can flow is formed between the inside of the outer cylinder 2 and the outside of the downhole power device 3. For example, the downhole power device 3 is disposed inside the outer cylinder 2 and is not in contact with the outer cylinder 2, and the space between the inside of the outer cylinder 2 and the outside of the downhole power device 3 is an annular space through which drilling fluid streams.

The left end of the downhole power device 3 is fixedly connected with the diversion member of the flow dividing device 1 through threads, so that the outer cylinder 2 and the downhole power device 3 are in a fixed state. The upper drill string rotates to drive the flow dividing device 1 to rotate, and the flow dividing device 1 rotates to drive the outer cylinder 2 and the downhole power device 3 to rotate. Of course, there are many ways of securing the outer cylinder 2 to the downhole power device 3. For example, a fastener may be provided between the inner wall of the outer cylinder 2 and the downhole power device 3. The fastener is capable of allowing the passage of drilling fluid (e.g., the first fluid stream) while securing the outer cylinder 2 and the downhole power device 3. However, the exemplary embodiment is not limited thereto, and the outer cylinder and the downhole power device may be fixed in other ways as long as the outer cylinder and the downhole power device can be fixedly arranged.

In the exemplary embodiment, a flow dividing device is provided that is capable of dividing the drilling fluid in the upper drill string into a first fluid stream and a second fluid stream. The first fluid stream enters an annular space between the outer cylinder and the downhole power device and is able to flow to the large cutting head to lubricate the large cutting head. The second fluid stream enters a power generation section of the downhole power device and serves as a power source for the power generation section. That is, the power generation section can convert the power of the second fluid stream into a rotational motion of the rotation output section. For example, the flow dividing device can have a diversion member that can have a central hole and a plurality of diversion holes disposed thereon. Wherein the plurality of diversion holes are capable of communicating drilling fluid in an upper drill string with the annular space and forming the first fluid stream; the central hole is configured to communicate drilling fluid of the upper drill string with the power generation section and form the second fluid stream. For example, as shown in FIGS. 2-4, the flow dividing device 1 can be a cylinder-like structure. The diversion member is arranged in the cylinder-like structure along the radial section and comprises a central hole 1*b* and a plurality of diversion holes 1*a* which are arranged around the central hole 1*b* and are not communicated with the central hole 1*b*. One portion of the drilling fluid from the upper drill string enters the central hole 1*b* to form a second fluid stream; the other portion of the drilling fluid enters the plurality of diversion holes 1*a* to form a first stream. The central hole 1*b* or the peripheral wall thereof extends towards the right end and is in threaded connection with the left end of the downhole power device 3, so that the second fluid stream enters the power generation section of the downhole power device 3 to provide a power source. A plurality of diversion holes 1*a* are associated with the annular space between the outer cylinder 2 and the downhole power device 3 so that the first fluid stream can enter the annular space and ultimately the large cutting head 5 to cool and lubricate the large cutting head 5. Here, the number of the plurality of diversion holes 1*a* may be 2 to 6, and the diversion holes 1*a* may be circular or elliptical diversion holes. The ratio of the sum of the radial cross-sectional areas of the plurality of diversion holes 1*a* to the radial cross-sectional area of the central hole 1*b*, that is, the ratio of the flow rates of the first fluid stream and the second fluid stream, may be 1:0.5 to 2, for example 1:1, etc. The drilling fluid from the upper drill string has a preset pressure, and the flow rates of the first fluid stream and the second fluid stream can be controlled by controlling the ratio of the radial sectional area of the diversion holes 1*a* to the radial sectional area of the central hole 1*b*, so that the purpose of shunting is achieved. However, the exemplary embodiment is not limited thereto, and the flow dividing device may have other structures as long as the diversion of the drilling fluid in the upper drill string can be achieved.

In the present exemplary embodiment, the downhole power device has a power generation section and a rotation output section. The power generation section is configured to generate power by the second fluid stream and rotate the rotation output section. The rotation output section is configured to be coupled to the small cutting head through the through hole of the large cutting head and to be capable of driving the small cutting head to rotate. For example, the power generation section of the downhole power device 3 may be a hydraulic drive motor or a hydraulic drive turbine, the second stream drives the power generation section to rotate, the power generation section drives the rotation output section to rotate, and the rotation output section drives the small cutting head 6 connected with the rotation output section to rotate through the through hole of the large cutting head 5. Or the left end extension part of the small cutting head 6 passes through the through hole of the large cutting head 5 to be connected with the rotation output section, so that the rotation is driven by the rotation output section. However, the exemplary embodiment is not limited thereto, and the downhole power device may have other structures as long as the downhole power device can generate power and drive the small cutting head to rotate under the action of the second fluid stream.

In the exemplary embodiment, the righting device can be provided with a quincunx-like cavity which can centralize a power generation section or a rotation output section of a downhole power device, or can centralize a part to be righted such as a part where the small cutting head is connected with the rotation output section, the part to be righted shakes in an outer cylinder, friction is reduced, and the stability and the service life of the dual-speed dual-core enhanced drilling equipment are improved.

Figure 5:
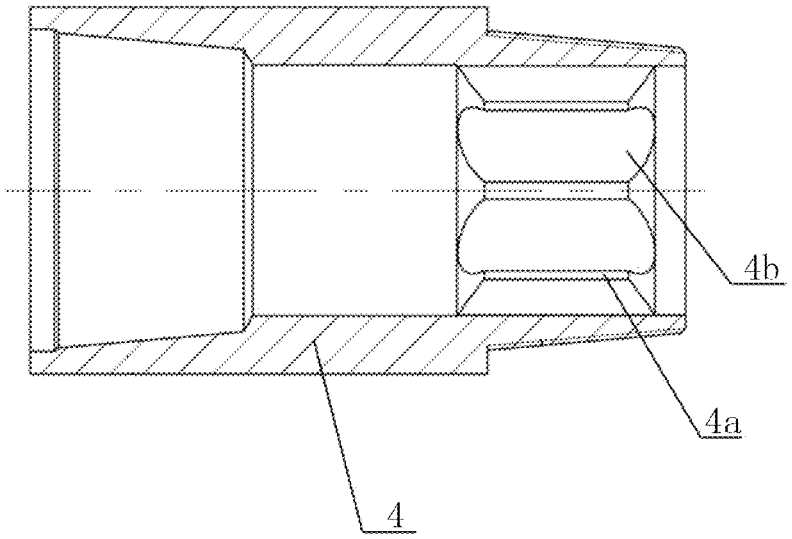
FIG. 5 illustrates a schematic structural view of a righting device in the dual-speed dual-core enhanced drilling equipments according to the exemplary embodiment.
Figure 6:
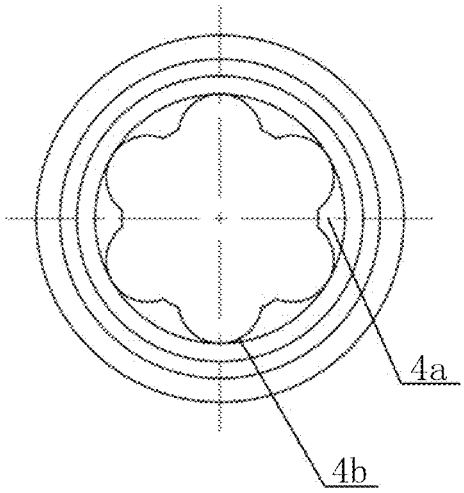
FIG. 6 illustrates a right side view of FIG. 5.
Figure 7:
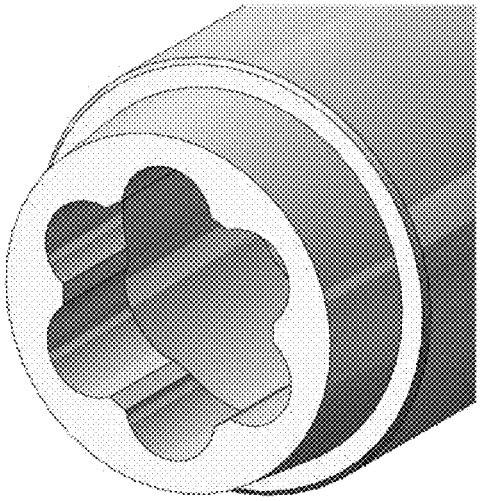
FIG. 7 illustrates a pictorial representation of FIG. 5.

FIG. 5 illustrates a schematic structural view of a righting device assembly in an exemplary embodiment of a dual-speed dual-core enhanced drilling equipments according to the exemplary embodiment. FIG. 6 shows a right side view of FIG. 5. FIG. 7 shows a pictorial representation of FIG. 5.

As shown in FIGS. 5 to 7, the right end of the righting device 4 may be a cavity shaped like a quincunx. The radial section of the quincunx-like cavity is quincunx-shaped. The quincunx-like cavity can be arranged on the inner wall of the right end part of the righting device 4 and is surrounded by a plurality of inner bosses 4*a* along the circumferential direction. Of course, the quincunx-like cavity may be arranged in central symmetry along the central axis of the righting device 4, or in non-central symmetry along the central axis of the righting device 4, and is determined according to the specific situation of the part to be centralized. For example, when the righting component is arranged in a non-centrosymmetric manner, the quincunx-like cavity is also arranged in a non-centrosymmetric manner; when the righted part is arranged in a central symmetry manner, the quincunx-like cavities are also arranged in a central symmetry manner. Here, the top surfaces of the inner bosses 4*a* are curved to fit the outer surface of the member to be centralized, and the curved shape of the top surfaces of the plurality of inner bosses 4*a* is located on an imaginary circumference having a diameter slightly larger than the diameter of the member to be centralized. Concave surfaces 4*b* are formed between two adjacent inner bosses 4*a*, and the number of concave surfaces 4*b* is equal to the number of inner bosses 4*a*. Here, the concave surface may be a circular arc shape, a U shape, or a V shape. While the righting device 4 centers the centered member, the second fluid stream entering the annular space may enter the large cutting head 5 through the passage between the outer surface of the centered member and the quincunx-like cavity to cool and lubricate the large cutting head 5. The concave surface is provided here in order to increase the cross-sectional area of the passage through which the drilling fluid streams. However, the exemplary embodiment is not limited in this regard and the righting device may have other configurations as long as it is capable of centralizing the component being centralized and allowing the flow of drilling fluid (e.g., the first fluid stream) therethrough.

In the exemplary embodiment, the small cutting head and the large cutting head are arranged in a non-centrosymmetric manner, and the diameter of the small cutting head is smaller than that of the large cutting head, so that the small cutting head can revolve around the central axis of the large cutting head under the drive of an upper drill string while rotating at a high speed under the drive of a downhole power device, thereby forming composite rotary drilling and solving the problem of low drilling speed caused by the linear velocity of the central point of the drill bit during drilling. For example, the central axis of the large cutting head 5 is a first centerline. The large cutting head 5 is provided with a through hole along a first centerline. The through hole is used for making the rotation output section of the downhole power device 3 through as to couple with the small cutting head 6, or for making the left end portion of the small cutting head 6 through as to couple with the rotation output section. The diameter of the large cutting head 5 is a first diameter, which may be the diameter of the outer periphery of the cutting cones on the large cutting head 5. The centre axis of the small cutting head 6 is the second centerline and the diameter of the small cutting head 6 is the second diameter. When the second diameter is smaller than the first diameter and the first centerline is parallel to but not coincident with the second centerline, the small cutting head 6 and the large cutting head 5 are disposed non-centrosymmetrically.

Here, the distance between the first centerline and the second centerline may be 1/50~1/10 of the first diameter, such as 1/30 first diameter, 1/20 first diameter, and the like. When the distance between the first centerline and the second centerline is smaller than 1/50 of the first diameter, the linear cutting speed of the central point of the drill bit is improved to certain extent; when the distance between the first centerline and the second centerline is controlled to be 1/50-1/10 first diameter, the cutting speed of a center point line of the drill bit can be well improved, and the drilling speed can be well improved; when the distance between the first centerline and the second centerline is larger than 1/10 the first diameter, the abrasion probability of the small cutting head 6 is increased, which may reduce the tool life to certain extent.

The small cutting head 6 rotates at a high speed under the drive of the downhole power device 3 and revolves around the first centerline under the drive of the upper drill string to do compound motion. As shown in FIG. 1, the small cutting head 6 extends beyond the large cutting head 5 by a distance (denoted L) such that the small cutting head 6 can first contact the bottom of the well to drill a small borehole in the bottom of the well, forming a hollow rock mass; the large cutting head 5 then drills the hollow rock mass away to form the final desired borehole. Here, $0<L<0.6$ m, and further $0.2<L<0.5$ m. When L is more than 0.2 and less than 0.5 m, better drilling speed improvement and tool service life can be obtained; when L is greater than 0.6 m, a large load is applied to the downhole power device 3, which may reduce the service life to certain extent.

When drilling operation is carried out, the small cutting head 6 rotates at a high speed under the drive of the downhole power device 3, and simultaneously revolves around the first centerline under the drive of the upper drill string to do composite motion, and meanwhile, the large cutting head 5 rotates under the drive of the upper drill string. Here, the rotation speed of the large cutting head 5 can be controlled in a range of 60 to 80 revolutions/min. The rotation speed range of the small cutting head 6 can be controlled to be 200-600 revolutions/min, and the revolution speed range of the small cutting head 6 can be controlled to be 60-80 revolutions/min. The angular velocity of rotation of the large cutting head 5 is R, the sum of the angular velocities of rotation and revolution of the small cutting head 6 is r, and the ratio r:R of the angular velocity r of the small cutting head 6 to the angular velocity R of the large cutting head 5 may be 2 to 9:1, more preferably 4 to 7:1. When the ratio of r:R is controlled to be 2-9:1, the drilling speed-up effect is better; when r:R is less than 2, the drilling speed is improved to a certain extent; when the r:R is more than 9, the power requirement of the downhole power device is higher, the abrasion probability of the small cutting head is increased, and the service life is reduced to a certain extent.

Figure 8:
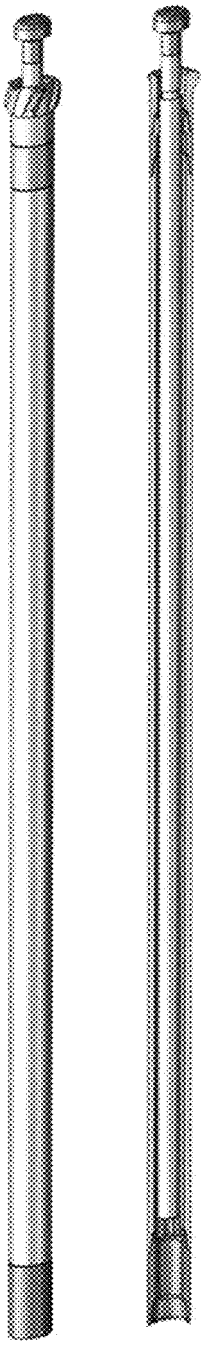
FIG. 8 illustrates a pictorial diagram of the dual-speed dual-core enhanced drilling equipments according to the exemplary embodiment.

In the present exemplary embodiment, the cutting head 6 is further provided with a jet channel which has a gradually decreasing cross-sectional area of the flow channel. The second fluid stream enters the small cutting head after driving the rotation output section to rotate, and is jetted to the bottom of the well through the jet channel to perform high-pressure jet drilling. For example, the small cutting head 6 may be provided with a plurality of jet channels along the second centerline, and the cross-sectional area of the jet channels is gradually reduced in the radial direction. The second fluid stream drives the power generation section to rotate and then enters the small cutting head 6 via the rotation output section, e.g. its central through hole. The second fluid stream may enter from the larger cross-section end of the jet channel of the cutting head 6, where the pressure gradually increases, eventually forming a high-pressure spray from the smaller cross-section end of the jet channel. The high-pressure jet drilling fluid can scour the well bottom at a high flow rate, help the drill bit to break rocks and improve the rock breaking efficiency of the drill bit, and can better clean the well bottom and a small cutting head to prevent cutting tooth mud bags and accelerate drilling. Here, the large cutting head and the small cutting head may be ordinary bits, and high-performance PDC bits may also be used. For example, a physical schematic diagram of the present exemplary embodiment may be as shown in FIG. 8.

Figure 9:
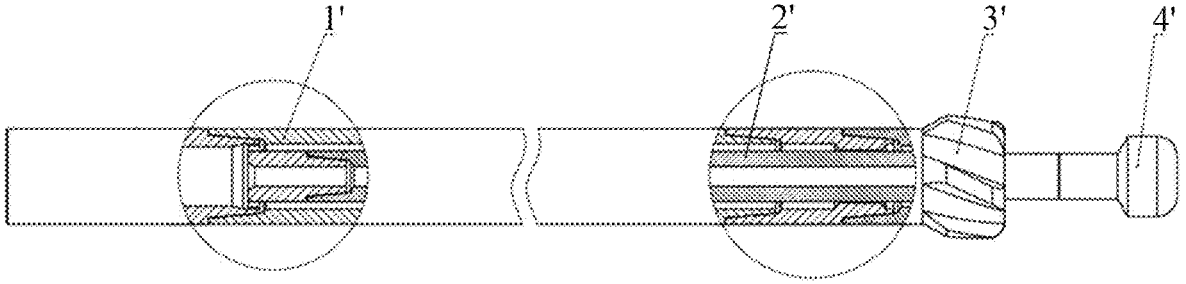
FIG. 9 illustrates a schematic diagram of the dual-speed dual-core enhanced drilling equipments according to another exemplary embodiment.

FIG. 9 illustrates a schematic structural view of an exemplary embodiment of a dual-speed, dual-core enhanced drilling equipments according to another exemplary embodiment.

In a third exemplary embodiment, as shown in FIG. 9, a dual-speed dual-core enhanced drilling equipments may include an outer cylinder 1', a downhole power device 2', a large cutting head 3', and a small cutting head 4'.

The large cutting head 3' has a first centerline, a through hole arranged along said first centerline, and a first diameter. The small cutting head 4' has a second centerline and a second diameter. And, the second diameter is smaller than the first diameter, and the second centerline is parallel to but not coincident with the first centerline. That is, both the first centerline and the second centerline may be parallel to the drilling direction, but there is a predetermined distance between the first centerline and the second centerline. For example, the distance between the first centerline and the second centerline may be 1/50-1/10 of the first diameter. As another example, the distance between the first centerline and the second centerline may be 1/20 for the first diameter.

The outer cylinder 1' is sleeved outside the downhole power device 2' and forms an annular space between the two. And the left end of the outer cylinder 1' is directly connected with the upper drill string, and the right end of the outer cylinder 1' is directly connected with the large cutting head 3' so that the large cutting head 3' can drill under the driving of the upper drill string. That is, the outer cylinder 1', the large cutting head 3' and the upper drill string may be fixed as one and may rotate together.

The downhole power device 2' may have a power generation section and a rotation output section. Wherein the power generation section is capable of generating power and rotating the rotation output section. Further, the downhole power device 2' can also form an annular space with the outer cylinder 1', and a power generation section of the downhole power device 2' can be fixedly connected with one or more of the upper drill string, the outer cylinder 1' and the large cutting head 3', so that the downhole power device 2' can rotate under the driving of the upper drill string. The rotation output section passes through the through hole of the large cutting head 3' to be connected with the small cutting head 4' and can drive the small cutting head 4' to rotate. The power source of the power generation section can be from drilling fluid or batteries or other electric power and the like.

That is, the downhole power device 2' can generate power through the power generation section and drive the small cutting head 4' to rotate around the second centerline through the rotation output section; at the same time, the downhole power device 2' as well as the small cutting head 4' are able to revolve around the first centerline due to the drive of the upper drill string. Thus, the angular velocity of the small cutting head 4' will be greater than the angular velocity of the large cutting head 3'. For example, the ratio of the angular velocity of the small cutting head 4' to the angular velocity of the large cutting head 3' may be 2 to 9:1. For another example, the ratio of the angular velocity of the small cutting head 4' to the angular velocity of the large cutting head 3' may be 4 to 7:1.

In a fourth exemplary embodiment, the dual-speed dual-core enhanced drilling equipment may be based on the above third exemplary embodiment, and the outer cylinder 1' further includes a quincunx-like cavity fixedly disposed in the right end portion of the outer cylinder 1'. The quincunx-like cavity can right the power generation section or the rotation output section of the downhole power device 2', or can right the part of the small cutting head 4' connected with the rotation output section. That is, the righting device is capable of centralizing the deflection caused by the rotation of the small cutting head 4'. The power generation section, the rotation output section or the small cutting head 4' can be rotated more stably by the quincunx-like cavity in the right end of the outer cylinder 1'.

In a fifth exemplary embodiment, the dual-speed dual-core enhanced drilling equipment may be based on the third exemplary embodiment described above, wherein the outer cylinder 1' further comprises a diversion member disposed within the left end of the outer cylinder 1' and between the upper drill string and the power generation section of the downhole power device 2'. The diversion member is provided with a central hole and a plurality of diversion holes. The plurality of diversion holes are capable of providing a portion of the drilling fluid (i.e., the first fluid stream) in the upper drill string into the annular space between the outer cylinder 1' and the downhole power device 2' and, and to the large cutting head 3' for lubrication of the large cutting head 3'. The central hole is capable of providing the other portion of the drilling fluid (i.e., the second fluid stream) of the upper drill string as a power source to the power generation section of the downhole power device 2'. The power generation section can convert the power of the second fluid stream into the rotary motion of the rotation output section, and then drive the small cutting head 4' to rotate.

In general, to solve the problem of zero linear velocity at the center point of the drill bit, the inventors propose another dual-speed dual-core enhanced drilling device. The dual-speed dual-core enhanced drilling equipment includes a large cutting head (also called a large drill bit) which is provided with a first central line, a receiving-coupling portion and a hollow cutting portion fixedly connected with each other along the first central line; and a small cutting head (also referred to as a small drill bit) which is provided with a second centerline; and the receiving-coupling portion comprises a coupling member and an inner volume cavity, the small cutting head being disposed in the inner volume cavity of the large cutting head, the second centerline being parallel to but not coincident with the first centerline to achieve "dual-core". At the same time, the large cutting head receives a first power for rotary drilling through the upper drill string and is provided with lubrication by drilling fluid from the upper drill string; the small cutting head obtains a second power for rotary drilling through the downhole power device, which is equivalent to the small cutting head rotating around the second central line, and the upper drill string can also drive the downhole power device to further drive the small cutting head to rotate, which is equivalent to the small cutting head revolving around the first central line, thereby realizing "dual-speed".

Figure 10:
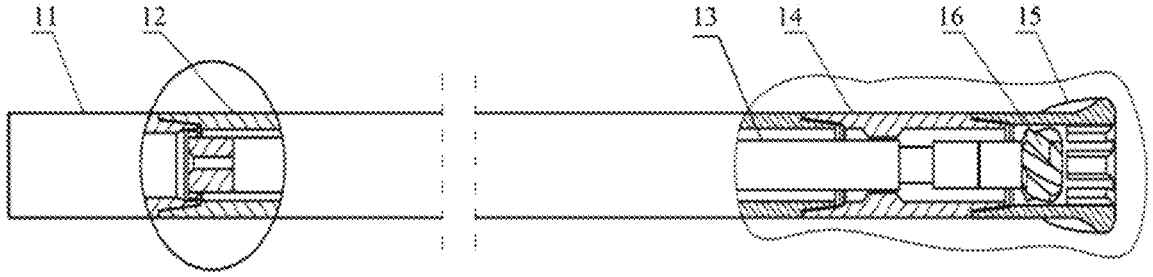
FIG. 10 illustrates a schematic diagram of the dual-speed dual-core enhanced drilling equipments according to another exemplary embodiment.
Figure 11:
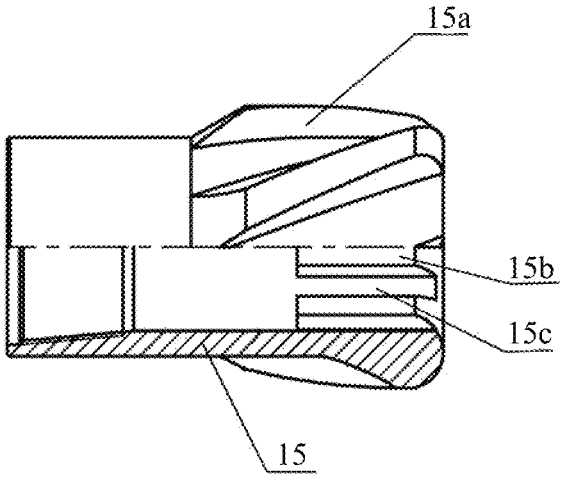
FIG. 11 illustrates a schematic structural view of a large cutting head of the dual-speed dual-core enhanced drilling equipments according to another exemplary embodiment.
Figure 12:
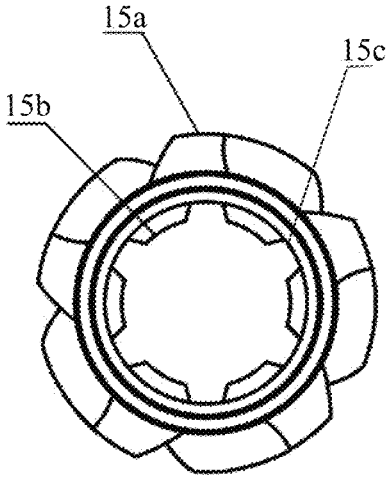
FIG. 12 shows a right side view of FIG. 11.
Figure 13:
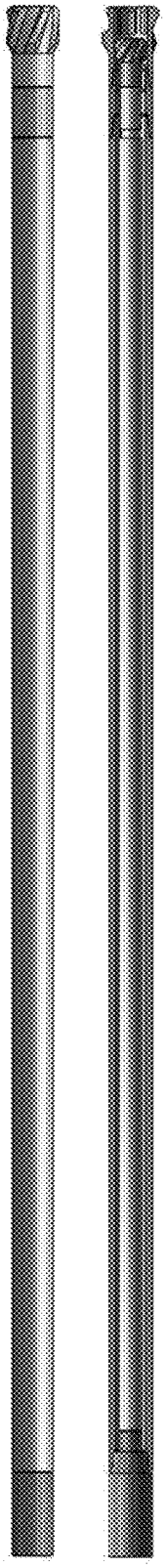
FIG. 13 illustrates a pictorial diagram of the dual-speed dual-core enhanced drilling equipments according to another exemplary embodiment.

FIG. 10 illustrates a schematic diagram of the dual-speed dual-core enhanced drilling equipments according to another exemplary embodiment. FIG. 11 illustrates a schematic structural view of a large cutting head of the dual-speed dual-core enhanced drilling equipments according to another exemplary embodiment. FIG. 12 shows a right side view of FIG. 11. FIG. 13 illustrates a pictorial diagram of the dual-speed dual-core enhanced drilling equipments according to another exemplary embodiment.

As shown in FIG. 10, the dual-speed dual-core enhanced drilling equipment according to another exemplary embodiment comprises a flow dividing device 11, an outer cylinder 12, a downhole power device 13, a righting device 14, a large cutting head 15 and a small cutting head 16.

In the exemplary embodiment, the left end of the outer cylinder 12 is connected with the upper drill string through the flow dividing device 11, and the right end of the outer cylinder 12 is connected with the large cutting head 15 through the righting device 14, so that the rotation torque of the upper drill string is transmitted to the large cutting head 15, and the large cutting head 15 can drill rotationally under the driving of the upper drill string. The outer cylinder 12 is indirectly connected with the upper drill string, and the outer cylinder 12 is indirectly connected with the large cutting head 15. For example, the left end of the outer cylinder 12 is connected with the right end of the flow dividing device 11 through threads, and the left end of the flow dividing device 11 is connected with the upper drill string through threads, so that the outer cylinder 12 is connected with the upper drill string, and the outer cylinder 12 can be driven by the upper drill string to rotate; the right end of the outer cylinder 12 is in threaded connection with the left end of the righting device 14, and the right end of the righting device 14 is in threaded connection with the left end of the large cutting head 15, so that the righting device 14 and the large cutting head 15 can rotate together with the outer cylinder 12. However, the exemplary embodiment is not limited thereto, and the upper drill string and the flow dividing device, the flow dividing device and the outer cylinder, the outer cylinder and the righting device, and the righting device and the large cutting head may be connected by other means (for example, snap-fitting), as long as the connection of the upper drill string, the flow dividing device, the outer cylinder, the righting device and the large cutting head and the transmission of the torque of the upper drill string can be realized.

In the present exemplary embodiment, the downhole power device 13 is disposed inside the outer cylinder 12, and the downhole power device 13 and the outer cylinder 12 are in a fixed state therebetween. The downhole power device 13 can rotate under the driving of an upper drill string together with the outer cylinder 12, and an annular space through which drilling fluid can flow is formed between the inside of the outer cylinder 12 and the outside of the downhole power device 13. For example, the downhole power device 13 is disposed inside the outer cylinder 12 and is not in contact with the outer cylinder 12, and the space between the inside of the outer cylinder 12 and the outside of the downhole power device 13 is an annulus through which drilling fluid flows.

The left end of the downhole power device 13 is fixedly connected with the diversion member of the flow dividing device 11 through threads, so that the outer cylinder 12 and the downhole power device 13 are in a fixed state. The upper drill string rotates to drive the flow dividing device 11 to rotate, and the flow dividing device 11 rotates to drive the outer cylinder 12 and the downhole power device 13 to rotate. Of course, there are many ways of securing the outer cylinder 12 to the downhole power device 13. For example, a fastener may be provided between the inner wall of the outer cylinder 12 and the downhole power device 13, which fastener is capable of allowing the passage of drilling fluid (e.g., the first fluid stream) while securing the outer cylinder 12 and the downhole power device 13. However, the exemplary embodiment is not limited thereto, and the outer cylinder and the downhole power device may be fixed in other ways as long as the outer cylinder and the downhole power device can be fixedly arranged.

The flow dividing device 11 may have the same structure as the flow dividing device 1.

The downhole power device may have a power generation section and a rotation output portion. The power generation section may be configured to generate power by the second fluid flow and rotate the rotation output section. The rotation output section may be a structure which can enter the inner volume cavity of the receiving-coupling portion of the large cutting head to be connected with the small cutting head and can drive the small cutting head to rotate. For example, the power generation section of the downhole power device 13 may be a hydraulic drive motor or a hydraulic drive turbine. The second fluid flow drives the power generation section to rotate; the power generation section drives the rotation output section to rotate; and the right end of the rotation output section, which enters the inner volume cavity of the large cutting head 15 and is connected with the small cutting head 16, drives the small cutting head 16 to rotate. Or the left end extension part of the small cutting head 16 passes through the coupling member of the large cutting head 15 to be connected with the rotation output section, so that the rotation of the small cutting head 16 is carried out by the driving of the rotation output section. However, the exemplary embodiment is not limited thereto, and the downhole power device may have other structures as long as the downhole power device can generate power and drive the small cutting head to rotate under the action of the second fluid flow.

The righting device 14 may have the same structure as the righting device 4.

As shown in FIGS. 11 to 12, the large cutting head 15 includes a receiving-coupling portion and a hollow cutting portion fixedly coupled to each other along the first centerline. In particular, the large cutting head may comprise a coupling member, an inner volume cavity and a cutting portion fixedly coupled in sequence from left to right. The coupling member may be used for coupling a large cutting head 15 with upstream equipment (e.g. an upper drill string, an outer cylinder or a righting device connected to the upper drill string, etc.); the inner volume cavity may be used for rotation of a small cutting head 16 therein in a direction parallel to the first centerline, and a cutting portion may be used for cutting the object to be drilled. The coupling member and the inner volume cavity together form a receiving-coupling portion.

The cutting portion may have an outer wall provided with an external cutting surface 15*a*, an inner wall provided with a plurality of internal cutting surfaces 15*b*, and a runner groove 15*c* formed between any two adjacent of the plurality of internal cutting surfaces 15*b*. Specifically, the outer wall and the inner wall of the cutting portion of the large cutting head 15 are respectively provided with the external cutting surface 15*a* and the internal cutting surface 15*b* for cutting the rock face to be drilled, and a borehole (i.e., an annular borehole) with a columnar core at the middle part is formed on the rock face through the combined action of the external cutting surface 15*a* and the internal cutting surface 15*b*, and the columnar core enters the inner volume cavity of the large cutting head 15 via the hollow cutting portion to be contacted with the small cutting head 16, so that the small cutting head 16 cuts the columnar core into rock debris. The runner groove 15*c* formed between the adjacent two internal cutting surfaces 15*b* may be used for discharging drilling fluid (e.g., from an upper drill rod, a small cutting head, etc.) inside the large cutting head 15 and debris formed by the small cutting head 16 cutting a columnar core out of the large cutting head 15. Here, the outer wall of the cutting portion may be drill-shaped. For example, the external cutting surfaces may be cones, cutting teeth, etc., which are progressively spaced from the first centerline from left to right and are helically disposed. Here, the numbers of the internal cutting surfaces 15*b* and the runner grooves 15*c* may be 3 to 8, respectively. For example, the numbers of the internal cutting surfaces and the runner grooves may be 5, respectively. The number of the external cutting surfaces 15*a* may be 3-8. For example, the number of the external cutting surfaces may be 15.

The receiving-coupling portion has a coupling and an inner volume cavity arranged along the first centerline. The inner volume cavity may be capable of receiving a small cutting head 16 arranged along a second centerline which is paralleling to but not coinciding with the first centerline. The small cutting head 16 has an outer diameter smaller than the outer diameter of the cutting portion. Specifically, the receiving-coupling portion of the large cutting head 15 includes a coupling member for coupling with an upstream equipment and an inner volume cavity for receiving the small cutting head 16. The inner volume cavity is disposed along the first centerline (i.e., in a left-right direction in FIG. 11) and is capable of accommodating the rotation of the small cutting head 16 disposed along the second centerline (i.e., the centerline of the small cutting head 16) therein. The large cutting head 15 and the small cutting head 16 are disposed in parallel but not in coincidence. The small cutting head 16 has an outer diameter smaller than that of the cutting portion of the large cutting head 15 so that the small cutting head 16 and the large cutting head 15 are disposed eccentrically. For example, the inner wall of the coupling member may have an inner diameter that tapers from left to right. Here, the coupling member may be a cylindrical structure with threads provided on the inner wall, and the large cutting head 15 may be fixedly coupled to the upstream equipment by the threads of the coupling member. However, the exemplary embodiment is not limited thereto, and the coupling member may be fixedly connected to the upstream device by means of snap-fitting or the like. Here, the inner diameter of the inner volume cavity may remain constant from left to right and be larger than the outer diameter of the small cutting head 16; the inner volume cavity may communicate with the runner groove 15*c*. Debris generated by cutting the columnar core with the small cutting head 16 can be discharged out of the large cutting head 15 through the runner groove together with drilling fluid.

The top surface of the internal cutting surface 15*b* near the first centerline may be concavely curved (e.g., circular arc-shaped). The internal cutting surfaces 15*b* may be symmetrically arranged around the first centerline. Here, the internal cutting surfaces 15*b* are symmetrically arranged around the first centerline in order to facilitate better drainage of drilling fluid and debris generated by the small cutting head 16 cutting the columnar core out of the inner volume cavity of the large cutting head 15. However, the exemplary embodiment is not limited thereto, and for example, the internal cutting surfaces may be spirally arranged from left to right about the first centerline.

When drilling, the large cutting head 15 is directly or indirectly connected with an upper drill string, so that the drilling pressure and the torque are large, the cutting portion of the large cutting head 15 is firstly contacted with a rock surface to be drilled to destroy the rock surface, the formation pressure is released, peripheral rocks are cut off to form an annular borehole, and a columnar core with a relatively easily-cut center is left. The columnar core enters the inner volume cavity from the hollow structure of the cutting portion to be in contact with the small cutting head 16, the small cutting head 16 revolves around the central line of the large cutting head while rotating at a high speed under the driving of the downhole power device, so that the high linear cutting speed is achieved, the columnar core cutting head can be cut into rock debris. The rock debris is discharged out of the large cutting head 15 from the runner groove 15*c* of the large cutting head 15 along with drilling fluid in an upper drill rod, the problem that the linear speed of the central point of a drill bit is zero can be avoided due to the mutual matching of the large cutting head 15 and the small cutting head 16, and the drilling speed is improved.

The small cutting head 16 and the large cutting head 15 may be arranged in a non-centrosymmetric manner, and the small cutting head 16 may be arranged in the inner volume cavity of the large cutting head, so that the small cutting head can revolve around the central axis of the large cutting head under the drive of an upper drill string while rotating at a high speed under the drive of a downhole power device, thereby forming composite rotary drilling and solving the problem of low drilling speed caused by the linear velocity of the central point of the drill bit during drilling.

Here, the distance between the first centerline and the second centerline may be 1/50~1/10 of the first diameter, such as 1/30 first diameter, 1/20 first diameter, and the like. When the distance between the first central line and the second central line is smaller than 1/50 the first diameter, the linear cutting speed of the central point of the drill bit is improved to certain extent; when the distance between the first centerline and the second centerline is controlled to be 1/50-1/10 first diameter, the cutting speed of a center point line of the drill bit can be well improved, and the drilling speed can be well improved; when the distance between the first centerline and the second centerline is larger than 1/10 the first diameter, the abrasion probability of the small cutting head 16 is increased, which may reduce the tool life to certain extent.

When drilling operation is carried out, the large cutting head 15 rotates under the driving of an upper drill string, and meanwhile, the small cutting head 16 positioned in the inner volume cavity of receiving-coupling portion rotates at a high speed under the driving of the downhole power device 13 and revolves around the first central line under the driving of the upper drill string to do compound motion. Here, the rotation speed of the large cutting head 15 can be controlled within a range of 60 to 80 revolutions per minute. The rotation speed range of the small cutting head 16 can be controlled to be 200-600 revolutions/min, and the revolution speed range of the small cutting head 16 can be controlled to be 60-80 revolutions/min. The angular velocity of rotation of the large cutting head 15 is R, the sum of the angular velocities of rotation and revolution of the small cutting head 16 is r, and the ratio r:R of the angular velocity r of the small cutting head 16 to the angular velocity R of the large cutting head 15 may be 2 to 9:1, more preferably 4 to 7:1. When the ratio of r to R is controlled to be 2-9:1, the enhanced drilling effect is better; when r:R is less than 2, the drilling speed is improved to a certain extent; when the r:R is more than 9, the power requirement of the downhole power device is higher, the abrasion probability of the small cutting head is increased, and the service life is reduced to a certain extent. Firstly, utilizing the characteristics of large drilling pressure and large torque of the large cutting head 15 to carry out early cutting on the stratum rock, releasing stratum stress, cutting off peripheral rock and leaving easy-to-cut core columnar rock; and then the characteristics of high rotating speed and high linear speed of the small cutting head 16 are utilized to cut the easy-to-cut core columnar rock, the advantages of mutual matching of the large cutting head and the small cutting head are complementary, the small cutting head overcomes the defects of low central linear speed and low cutting speed of the large cutting head, and the large cutting head overcomes the defects of low drilling pressure and low torque of the small cutting head, so that the problem of zero central linear speed of a drill bit is avoided, and the rock breaking efficiency is improved.

The small cutting head 16 may be further provided with a jet channel with a gradually decreasing cross-sectional area of a flow passage, and the second fluid flow enters the small cutting head after driving the rotation output section to rotate, and is jetted onto the columnar core through the jet channel to perform high-pressure jet drilling. For example, the small cutting head 16 may be provided with a plurality of jet channels along the second centerline, and the cross-sectional area of the jet channels in the radial direction may gradually reduced. The second fluid drives the power generating part to rotate and then enters the cutting head 16 via the rotation output section, e.g. its central through hole. The second fluid stream may enter from the larger cross-section end of the jet channel of the cutting head 16, where the pressure gradually increases, eventually forming a high-pressure spray from the smaller cross-section end of the jet channel. The high-pressure jet drilling fluid can scour the columnar rock core at a high flow rate, help the small cutting head to cut the columnar rock core and improve the cutting efficiency of the small cutting head, and can better clean the internal cutting surface of the large cutting head to prevent cutting tooth mud bags and accelerate drilling. Here, the large cutting head and the small cutting head may be ordinary bits, and high-performance PDC bits may also be used. For example, a physical schematic diagram of the present exemplary embodiment may be as shown in FIG. 13.

In summary, the dual-speed dual-core enhanced drilling equipments of the exemplary embodiment has one or more of the following advantages:

1. the large cutting head and the small cutting head are arranged in a non-centrosymmetric manner, and the small cutting head revolves around the central axis of the large cutting head while rotating at a high speed under the driving of an downhole power device, so that the problem that the theoretical cutting linear velocity of the central point of the drill bit is zero is solved, and the drilling speed is improved;

2. compared with the well with the same size, the size, the torque and the cost of the bottom hole power drilling tool are reduced under the condition of realizing the same rotating speed;

3. under the conditions of not increasing the discharge capacity of the drilling fluid and the pressure of the pump, the speed-up effect of high-pressure jet drilling can be formed in the middle of the bottom of the well;

4. the large cutting head is driven by the drill disk, the small cutting head is driven by the rotary disk and the downhole power device together, and the small cutting head has higher angular speed than the large cutting head, so that the small cutting head has higher linear speed, and the drilling speed is improved.

Although the exemplary embodiment has been described above in connection with the exemplary embodiments and the accompanying drawings, it will be apparent to those of ordinary skill in the art that various modifications may be made to the above-described embodiments without departing from the spirit and scope of the claims.

What is claimed is:

1. A dual-speed, dual-core enhanced drilling equipment comprising:

a flow dividing device;

an outer cylinder;

a downhole power device;

a righting device;

a large cutting head having a first outer edge; and a small cutting head having a second outer edge;

wherein the large cutting head has a first centerline, a through hole disposed along the first centerline, and a first diameter, the small cutting head has a second centerline and a second diameter, the second diameter is smaller than the first diameter, the second centerline is parallel to and offset from the first centerline;

wherein the outer cylinder is sleeved outside the downhole power device to form an annular space, a left end of the outer cylinder is connected with an upper drill string through the flow dividing device, and a right end of the outer cylinder is connected with the large cutting head through the righting device, and the upper drill string drives both the downhole power device and the large cutting head;

wherein the downhole power device is provided with a power generation section and a rotation output section, the power generation section generates power and rotates the rotation output section, and the rotation output section passes through the through hole of the large cutting head and connects with the small cutting head to drive the small cutting head;

wherein the righting device is to right the power generation section, the rotation output section, or the small cutting head;

wherein the flow dividing device separates drilling fluid in the upper drill string into a first fluid stream that enters the annular space for lubricating the large cutting head and a second fluid stream that enters the power generation section of the downhole power device;

wherein when the small cutting head revolves around the first centerline, the second outer edge of the small cutting head does not extend beyond the first outer edge of the large cutting head in a direction that is perpendicular to the first and center centerlines; and wherein an internal cutting surface of the large cutting head has one or more one runner grooves that separates two or more extended sections to facilitate fluid drainage and removal of debris generated by the small cutting head.

2. The dual-speed, dual-core enhanced drilling equipment according to claim 1, Wherein an offset distance between the first centerline and the second centerline is 1/50-1/10 of the first diameter.

3. The dual-speed, dual-core enhanced drilling equipment according to claim 1, wherein a ratio of an angular velocity of the small cutting head to an angular velocity of the large cutting head is 4-7:1.

4. The dual-speed, dual-core enhanced drilling equipment according to claim 1, wherein the small cutting head has a jet channel with a gradually decreasing radial cross-sectional area, one end of the jet channel receiving the second fluid stream flowing through the power generation section and emitting from the other end of the jet channel.

5. The dual-speed, dual-core enhanced drilling equipment according to claim 1, wherein the righting device has a quincunx—like cavity capable of righting the power generation section or the rotation output section, or of righting a portion of the small cutting head coupled to the rotation output section.

6. The dual-speed, dual-core enhanced drilling equipment according to claim 1, wherein the flow dividing device has a diversion member which has a central hole and a plurality of diversion holes, the plurality of diversion holes are configured to communicate drilling fluid in the upper drill string with the annular space and form the first fluid stream, and the central hole is configured to communicate drilling fluid in the upper drill string with the power generation section and form the second fluid stream.

7. A manufacturing method of the dual-speed, dual-core enhanced drilling equipment according to claim 1 comprising the following steps:

forming the flow dividing device, the outer cylinder, the downhole power device, the righting device, the large cutting head and the small cutting head; and the flow dividing device, the outer cylinder, the downhole power device, the righting device, the large cutting head and the small cutting head are assembled to form the dual-speed, dual-core enhanced drilling equipment.

8. The manufacturing method according to claim 7, wherein an offset distance between the first centerline and the second centerline is 1/50-1/10 of the first diameter.

9. The manufacturing method according to claim 7, wherein a ratio of an angular velocity of the small cutting head to an angular velocity of the large cutting head is 4-7:1.

10. The manufacturing method according to claim 7, wherein the small cutting head has a jet channel with a gradually decreasing radial cross-sectional area, one end of the jet channel receiving the second fluid stream flowing through the power generation section and emitting from the other end of the jet channel.

11. The manufacturing method according to claim 7, wherein the righting device has a quincunx-like cavity capable of righting the power generation section or the rotation output section, or of righting a portion of the small cutting head coupled to the rotation output section.

12. The manufacturing method according to claim 7, wherein the flow dividing device has a diversion member which has a central hole and a plurality of diversion boles, the plurality of diversion holes are configured to allow drilling fluid in the upper drill string to communicate with the annular space and form the first fluid stream, and the central hole is configured to allow drilling fluid in the upper drill string to communicate with the power generation section and form the second fluid stream.

13. The dual-speed, dual-core enhanced drilling equipment according to claim 1, Wherein an offset distance between the first centerline and the second centerline is not greater than 1/10 of the first diameter.

14. A dual-speed, dual-core enhanced drilling equipment comprising:

a flow dividing device;

an outer cylinder;

a downhole power device;

a righting device;

a large cutting head having a first outer edge; and a small cutting head having a second outer edge;

wherein the large cutting head has a first centerline, a receiving-coupling portion and a hollow cutting portion having a first diameter, the receiving-coupling portion and the hollow cutting portion fixedly coupled to each other along the first centerline, the small cutting head has a second centerline and a second diameter, the receiving-coupling portion has a coupling member and an inner volume cavity disposed along the first centerline, the inner volume cavity being capable of receiving the small cutting head, the second centerline is parallel to and offset from the first centerline, the second diameter is smaller than the first diameter;

wherein the outer cylinder is sleeved outside the downhole power device to form an annular space, a left end of the outer cylinder is connected with an upper drill string through the flow dividing device, and a right end of the outer cylinder is connected with the coupling member of the receiving-coupling portion of the large cutting head through the righting device, and the upper drill string drives both the downhole power device and the large cutting head;

wherein the downhole power device is provided with a power generation section and a rotation output section, the power generation section generates power and rotates the rotation output section, and a right end of the rotation output section enters the inner volume cavity of the receiving-coupling portion of the large cutting head to be connected with the small cutting head to drive the small cutting head;

wherein the righting device is to right the power generation section, the rotation output section, or the small cutting head;

wherein the flow dividing device separates drilling fluid in the upper drill string into a first fluid stream that enters the annular space for lubricating the large cutting head and a second fluid stream that enters the power generation section of the downhole power device;

wherein when the small cutting head revolves around the first centerline, the second outer edge of the small cutting head does not extend beyond the first outer edge of the large cutting head in a direction that is perpendicular to the first and second centerlines, and wherein the internal cutting surface of the large cutting head has one or more one runner grooves that separates two or more extended sections to facilitate fluid drainage and removal of debris generated by the small cutting head.

15. The dual-speed, dual-core enhanced drilling equipment according to claim 14, wherein an offset distance between the first centerline and the second centerline is 1/50-1/10 of the first diameter.

16. The dual-speed, dual-core enhanced drilling equipment according to claim 14, wherein a ratio of an angular velocity of the small cutting head to an angular velocity of the large cutting head is 4-7:1.

17. The dual-speed, dual-core enhanced drilling equipment according to claim 14, wherein the small cutting head has a jet channel with a gradually decreasing radial cross-sectional area, one end of the jet channel receiving the second fluid stream flowing through the power generation section and emitting from the other end of the jet channel.

18. The dual-speed, dual-core enhanced drilling equipment according to claim 14, wherein the righting device has a quincunx — like cavity capable of righting the power generation section or the rotation output section, or of righting a portion of the small cutting head coupled to the rotation output section.

19. The dual-speed, dual-core enhanced drilling equipment according to claim 14, wherein the flow dividing device has a diversion member which has a central hole and a plurality of diversion holes, the plurality of diversion holes are configured to communicate drilling fluid in the upper drill string with the annular space and form the first fluid stream, and the central hole is configured to communicate drilling fluid in the upper drill string with the power generation section and form the second fluid stream.

20. The dual-speed, dual-core enhanced drilling equipment according to claim 14, wherein an offset distance between the first centerline and the second centerline is not greater than 1/10 of the first diameter.

* * * * *